US006237220B1

(12) United States Patent
Apel et al.

(10) Patent No.: US 6,237,220 B1
(45) Date of Patent: May 29, 2001

(54) METHOD FOR MANUFACTURING ELASTIC STRIPS, PIN HOLDERS AND SIMILAR PLUG-IN CONNECTORS

(75) Inventors: Ulrich Apel, Sprockhövel; Manfred Koch, Witten; Dieter Klatt, Wüfrath, all of (DE)

(73) Assignee: Stocko Metallwarenfabriken Henkels und Sohn GmbH & Co. (DE)

( * ) Notice: Subject to any disclaimer, the term of this patent is extended or adjusted under 35 U.S.C. 154(b) by 0 days.

(21) Appl. No.: 09/232,147

(22) Filed: Jan. 15, 1999

(30) Foreign Application Priority Data

Jan. 16, 1998 (DE) ..... 198 01 409

(51) Int. Cl.[7] ..... H01R 43/00

(52) U.S. Cl. ..... 29/883; 29/874; 29/876; 29/884; 439/83

(58) Field of Search ..... 29/883, 884, 874, 29/876, 879; 439/885, 937, 75, 78, 83, 590, 398; 264/277

(56) References Cited

U.S. PATENT DOCUMENTS

| | | | | |
|---|---|---|---|---|
| 3,835,444 | * | 9/1974 | Plana et al. | 339/98 |
| 3,927,698 | * | 12/1975 | Johannsen | 138/162 |
| 4,172,218 | * | 10/1979 | Sugissaka | 200/273 |
| 4,173,387 | * | 11/1979 | Zell | 339/196 |
| 4,187,068 | * | 2/1980 | Vassar | 425/381 |
| 4,188,715 | * | 2/1980 | Ammon et al. | 29/629 |
| 4,230,387 | * | 10/1980 | Zahn | 339/59 M |
| 4,553,801 | | 11/1985 | Zajeski . | |
| 4,614,143 | | 9/1986 | Ingwersen . | |
| 4,832,622 | | 5/1989 | Zahn . | |
| 4,857,670 | * | 8/1989 | Frank et al. | 174/68.3 |
| 5,201,663 | * | 4/1993 | Kikuchi et al. | 439/83 |
| 5,428,890 | | 7/1995 | Zahn . | |
| 5,588,849 | * | 12/1996 | Kile | 439/83 |
| 6,041,498 | * | 3/2000 | Hillbish et al. | 29/883 |

FOREIGN PATENT DOCUMENTS

| | | |
|---|---|---|
| 41 05 970 | 9/1992 | (DE) . |
| 0 275 869 | 7/1988 | (EP) . |
| 0 677 892 | 10/1995 | (EP) . |
| 0 753 901 | 1/1997 | (EP) . |

* cited by examiner

*Primary Examiner*—Gregory L. Huson
*Assistant Examiner*—Minh Trinh
(74) *Attorney, Agent, or Firm*—Robert W. Becker & Associates

(57) ABSTRACT

A method for manufacturing elastic strips, pin holders, and plug-in connectors includes the step of extruding a continuous profiled plastic member having a profile matching the desired geometry of a plug-in connector and storing the continuous profiled plastic member. The continuous profiled plastic member is then provided with cutouts in areas where cutouts cannot be produced by extrusion. Subsequently, electrical contacts are mounted on the continuous profiled plastic member. This continuous profiled plastic member is then again stored. The continuous profiled plastic member is then cut to length to form a connector blank having a desired number of electrical contacts and a guide contour is then formed at the connector blank.

12 Claims, 4 Drawing Sheets

METHOD FOR MANUFACTURING ELASTIC STRIPS, PIN HOLDERS AND SIMILAR PLUG-IN CONNECTORS

BACKGROUND OF THE INVENTION

The present invention relates to a method for manufacturing plug-in connectors. Plug-in connectors are known in various embodiments and are used for electrically connecting individual components of electric/electronic devices. They consist of one-part or two-part plug and socket strips having an insulating member which separates contact elements providing a certain number of poles and arranged in a grid from one another. The insulating member receiving the contact elements can be a unitary part of a housing or a separate component. The housing provides protection against outer mechanical loading and is, in general, provided with a guide contour that allows centering while avoiding an incorrect attachment of the corresponding housing bottom or top part. The assembly of the housing top part and bottom part is achieved by a detachable quick connection which can be, for example, a plug-in connection.

For producing such plug-in connectors, it is known to produce the insulating member, respectively, the housing parts as injection-molded individual plastic parts into which individual or strip-shaped contact elements are placed. Such a method is, for example, known from European Patent application 0 753 901 A2. A disadvantage of this method is the cost-intensive and inflexible manufacture resulting, on the one hand, from the high investment capital for the manufacturing machines, and, on the other hand, from the long retooling times. For example, for each desired number of contacts/poles a suitable injection molding tool is required so that a cost-intensive number of such tools must be stocked which is even larger when taking into consideration the different types of grid arrangements. Furthermore, for each desired change of the contact number or the grid arrangement, an expensive retooling of the machining stations arranged downstream is required so that the prior art process is not suitable for a fast and easy manufacture of different plug-in connectors, but instead requires complicated and difficult manufacturing steps.

It is therefore an object of the present invention to provide a method for producing plug-in connectors of the aforementioned kind which, while avoiding the aforementioned disadvantages, allow for a simple and inexpensive as well as flexible manufacture of complex plug-in connectors.

SUMMARY OF THE INVENTION

The object of the present invention is inventively solved by a method that can be divided into three distinct parts. In a first part a profiled member is extruded in a continuous shape of a moldable plastic molding material whereby the profile corresponds to the required geometry of the plug-in connector and the resulting extruded profiled members are then stored in large quantities (in-process stock). In a second method part, the profiled member is then provided with cutouts in areas where such cutouts cannot be produced by the extrusion process, and, before being stored (in-process stock) again, the profiled member is provided with electrically conducting contacts. In a third part of the method, the profiled member is cut to length so as to have a desired number of electrical contacts or poles and is also provided with a guide contour.

With such a method different types of plug-in connectors can be produced in a substantially simplified and more flexible manner. This simplification is made possible by carrying out the shaping in two separate processes, i.e., extrusion, on the one hand, and providing the extruded profiled member with cutouts, for example, for receiving the contacts. This allows for an extrusion of the profiled member independent of the grid arrangement and independent of the number of contacts in a first process sequence so that the expensive arsenal of different extrusion tools can be considerably reduced. In this manner, all different variants of a plug-in connection system, for example, pin, IDC, crimp, edge, card, cutting clamping, soldering or foil connectors can be produced economically. A further contribution to the inventive simplification is that the profiled members are extruded as endless profiled members which are cut to length in the last process sequence according to desired number of poles and then provided with a guide contour matching the selected number of poles, so that a cost-intensive machining of loose, individual parts is eliminated. By employing an extrusion tool instead of the otherwise conventional injection-molding tools to produce individual connectors, an efficient material use is provided because the material consumption for molding distributors or similar means is reduced.

A special advantage is that the profiled member in the first part of the inventive method (first process sequence) is provided with a film joint or a rated break line so that in this manner the profiled member has two parts that are pivotable or foldable relative to one another. In a subsequent step the two parts are provided at their free ends with catch elements that are embodied as a unitary part of the two parts. These catch elements are used to secure the two parts at one another. Advantageously, the pivoting action of one part of the profiled member about a predetermined angle, for example, 90°, allows producing contours in areas which are otherwise inaccessible for the extrusion process as well as for the cutting process with which the cutouts are produced.

It is furthermore advantageous that in the second part of the method the chambers for receiving the contact elements, which are arranged in a grid arrangement, are stamped into the profiled members so that the same profiled member can be provided with different types of grids. The stamping action will also compensate shrinkage resulting from the extrusion process and thus will provide high precision with regard to positioning of the contact elements.

According to another advantageous embodiment of the invention, in the second part of the method cutouts for a cable guide are stamped/cut into the profiled member so that the cables connected to the plug-in connectors can be guided as desired away from the plug-in connector. Accordingly, a cable position of 90° to 180° to the plane of one of the fastening surfaces, for example, the printed circuit board, can be realized. Expediently, the cutouts for the cable guide are embodied such that a strain relief for the cables will result. For this purpose, the cutouts can be provided with constrictions that allow clamping of the cables.

It is furthermore expedient to cut to length the profiled member in the last part of the method by a cutting process and to provide the guide contour by a cutting process. For this purpose, especially laser cutting devices and water jet cutting devices, saws as well as stamping devices have been used advantageously.

In order to provide a simple color coding of the plug-in connection, according to a further advantageous feature of the invention a multi-color extrusion process is carried out. Advantageously, in the last part of the method multiple such profiled members are connected to one another so that in the same process complex plug-in connector geometries can be realized in a simple manner. It is suggested in this context to connect the different profiled members, depending on the respective specifications, by ultrasound welding, adhesives, catch connections etc. in order to provide detachable or non-detachable connections.

In order to provide for a proper storage, according to another advantageous embodiment of the invention the profiled member is stored in the form of a wound coil or bundles of cut-to-length rods. This is especially advantageous for process with just-in-time sequence, resulting in cost savings with regard to storing and thus a reduced capital expenditure. Finally, it is suggested that after the second and/or last part of the method a quality control is to be performed which, for example, detects the presence or absence of contact elements and marks detected flaw locations as well as removes components having such flaws.

BRIEF DESCRIPTION OF THE DRAWINGS

The object and advantages of the present invention will appear more clearly from the following specification in conjunction with accompanying drawings, in which.

DESCRIPTION OF PREFERRED EMBODIMENTS

Figure 1:
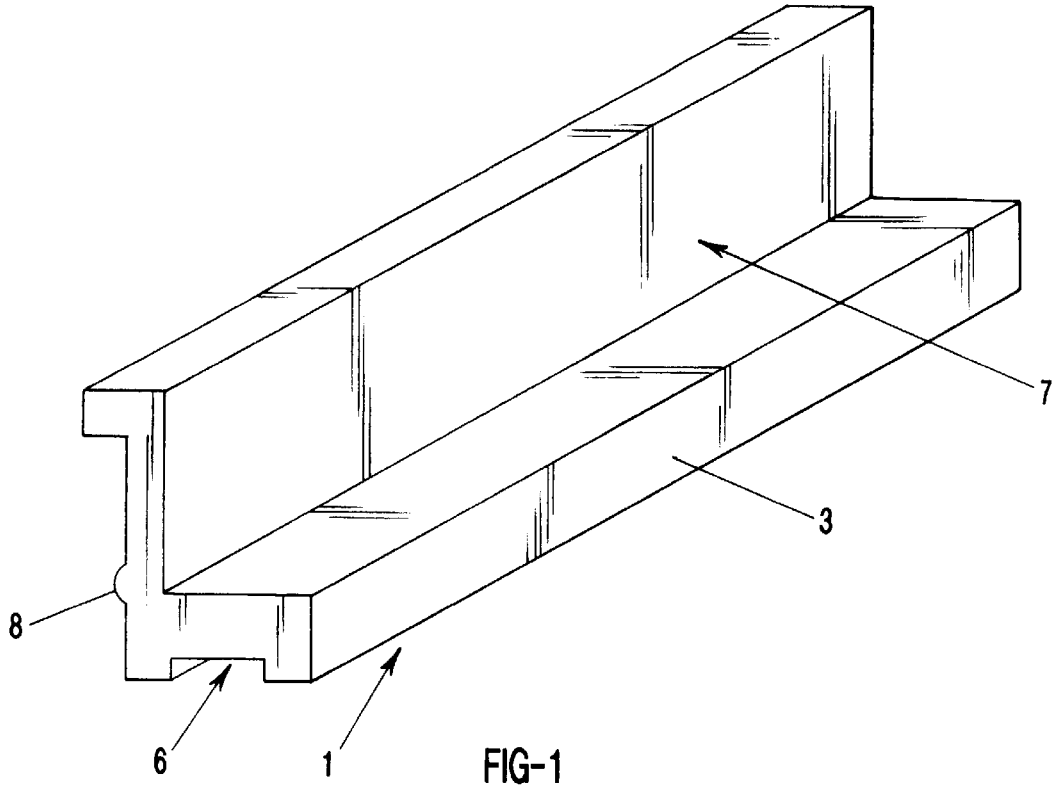
FIG. 1 shows an extruded profiled member in a perspective view after completion of the first method part.
Figure 2:
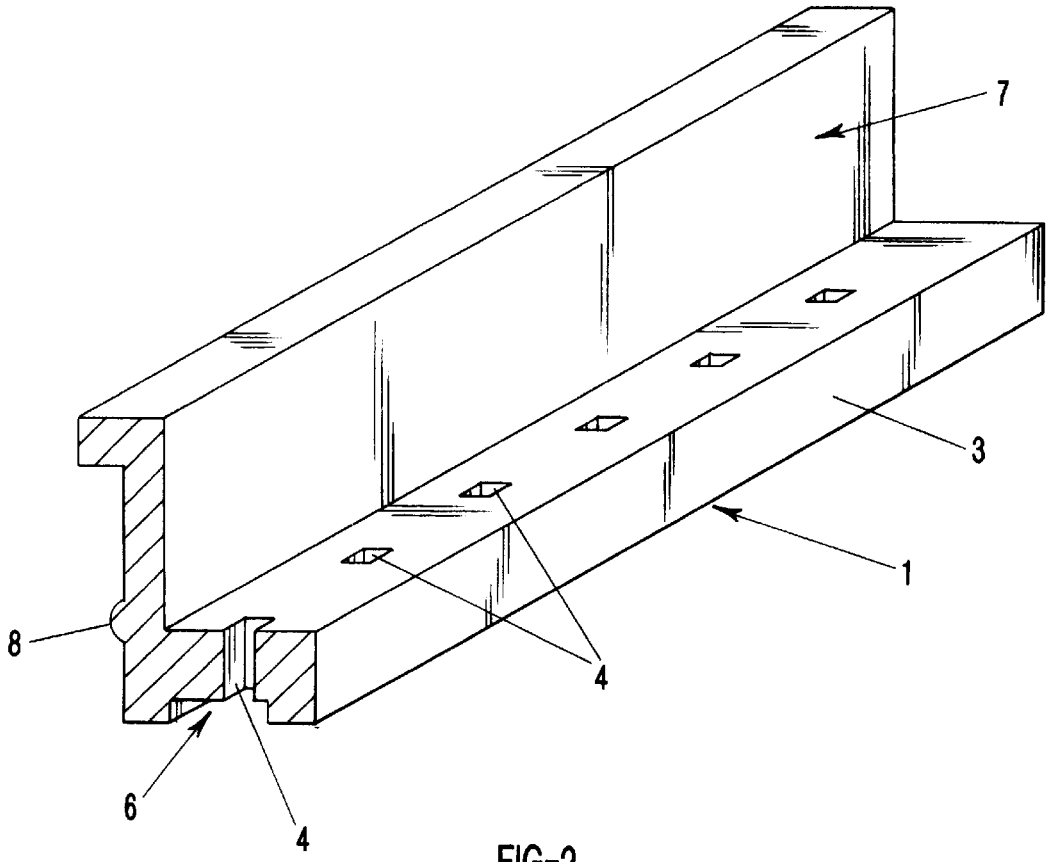
FIG. 2 shows the profiled member according to FIG. 1 in a sectional and perspective view as produced during the second method part.
Figure 3:
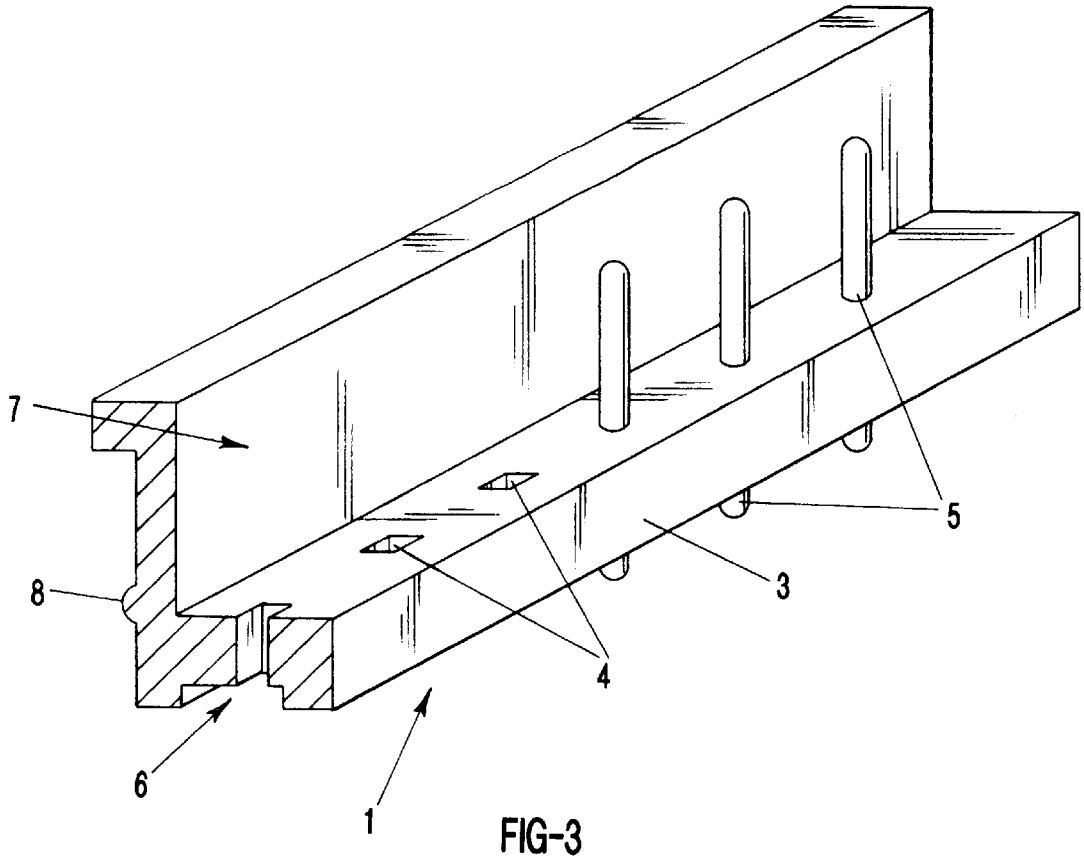
FIG. 3 shows the profiled member according to FIGS. 1 and 2 after completion of the second method part in a sectional and perspective view.
Figure 4:
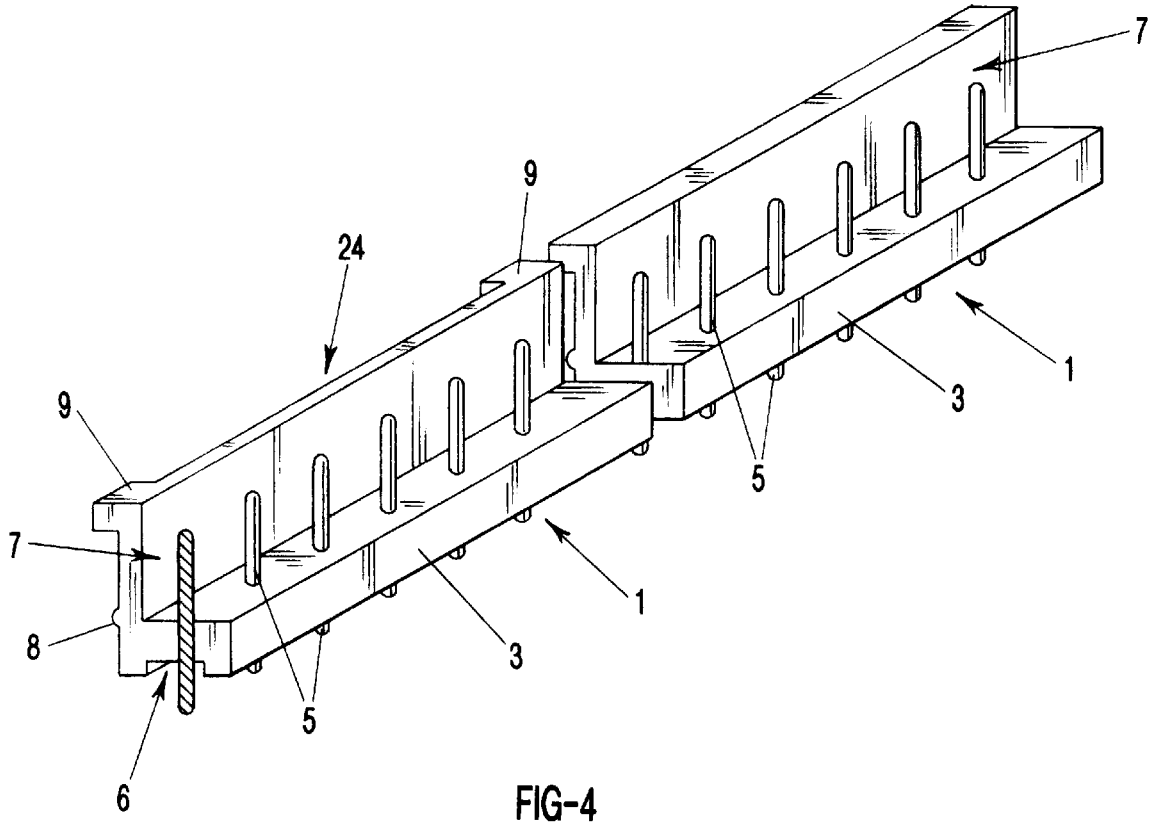
FIG. 4 shows the profiled member according to FIGS. 1 through 3 upon completion of the last method part in a perspective view.
Figure 5:
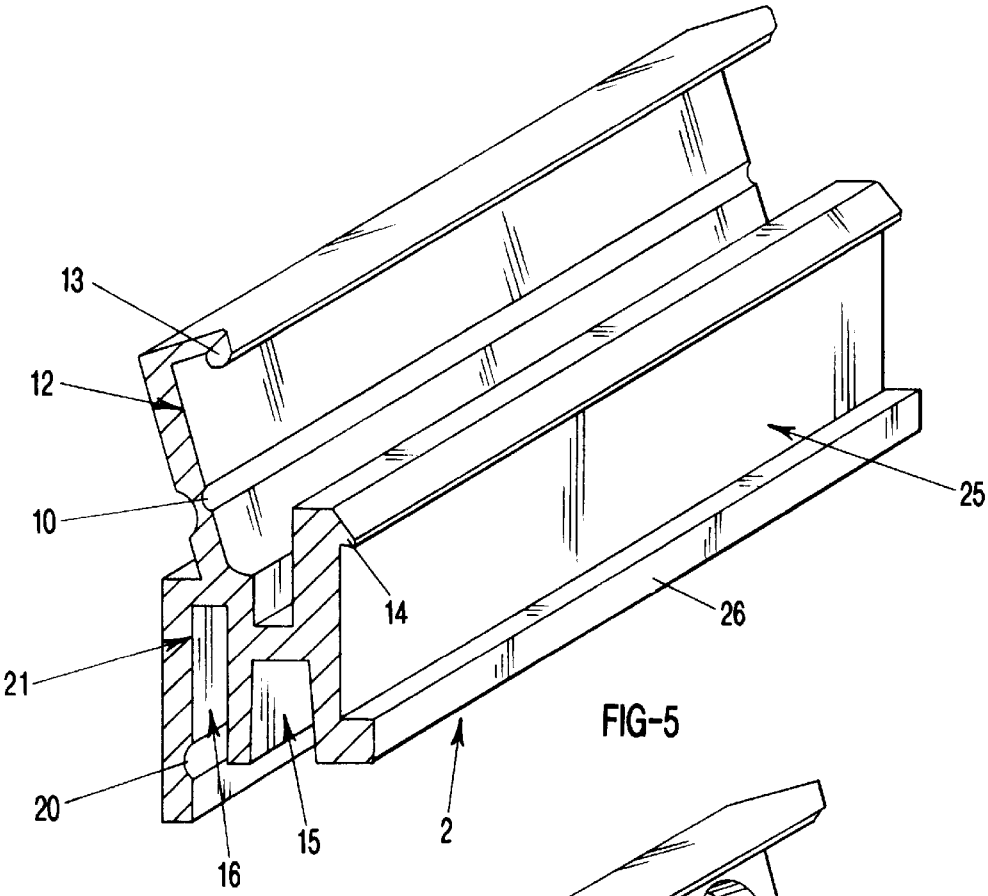
FIG. 5 shows a different profiled member after completion of the first method part in a sectional and perspective view.
Figure 6:
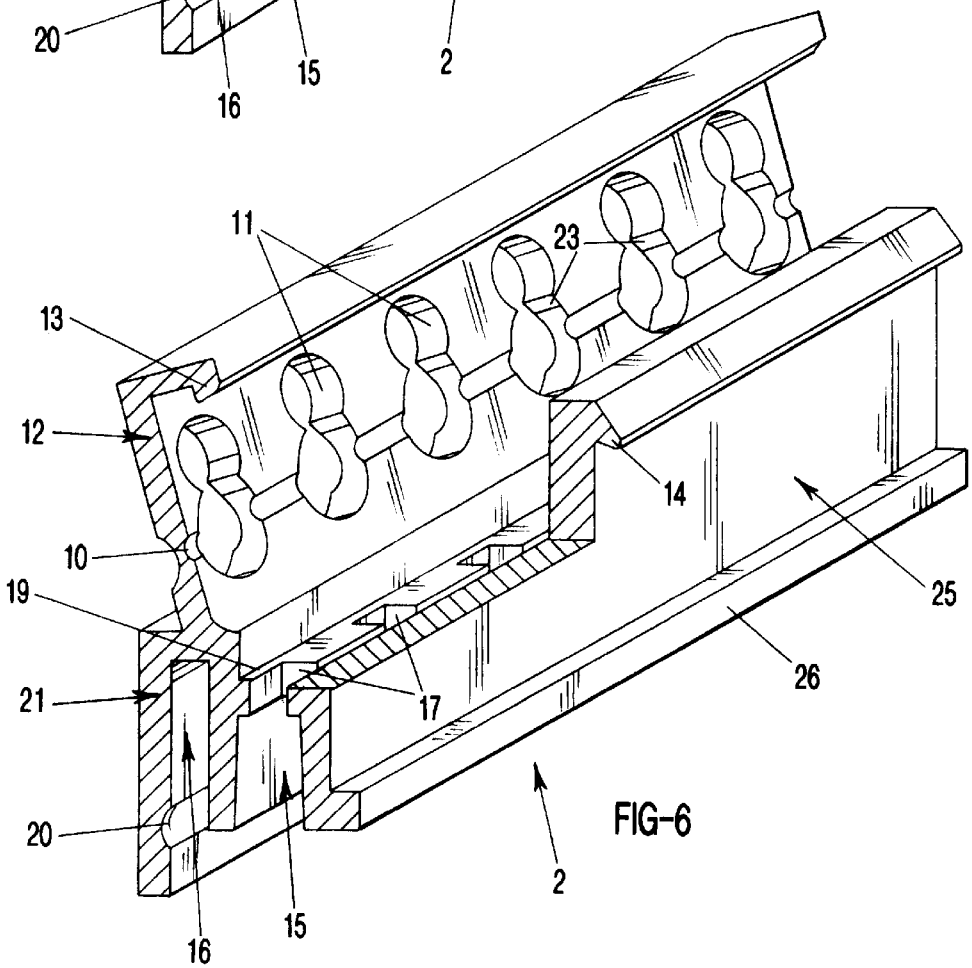
FIG. 6 shows the profiled member according to FIG. 5 in an embodiment which is produced by the second method part, shown in a part-sectional view.

The present invention will now be described in detail with the aid of several specific embodiments utilizing FIGS. 1 through 8.

The profiled members represented in the drawings are combined to a plug-in connector which is comprised of a pin holder 1, which is shown in FIGS. 1 through 4 and 8, as well as a housing part 2, which is represented in FIGS. 5 through 8. The pin holder 1 has an insulating member 3 provided with chambers 4 arranged in a grid arrangement into which pin-shaped contact elements 5 are inserted. At the underside of the insulating member 3 a groove 6 is provided from which the pin-shaped contact elements 5 penetrate and which serves to degas the components during soldering of the contact elements 5 onto the printed circuit board etc. The pin holder 1 has a substantially L-shaped cross-section whereby in the longitudinal direction of the pin holder 1 a wall 7 is positioned which at its outer side is provided with a catch projection 8 extending in the longitudinal direction as well as with centering cams 9.

Figure 7:
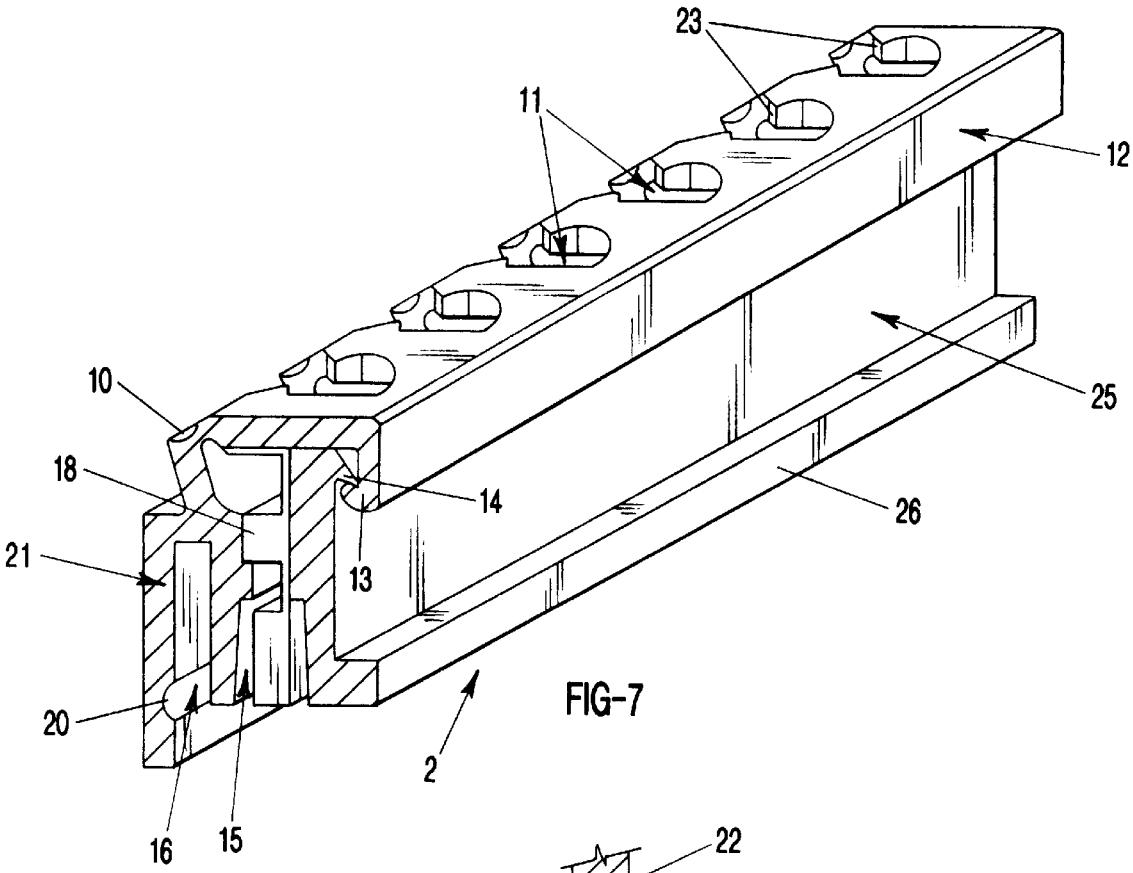
FIG. 7 shows the profiled member of FIGS. 5 and 6 after completion of the last method part with secured closure section in a sectional and perspective view.
Figure 8:
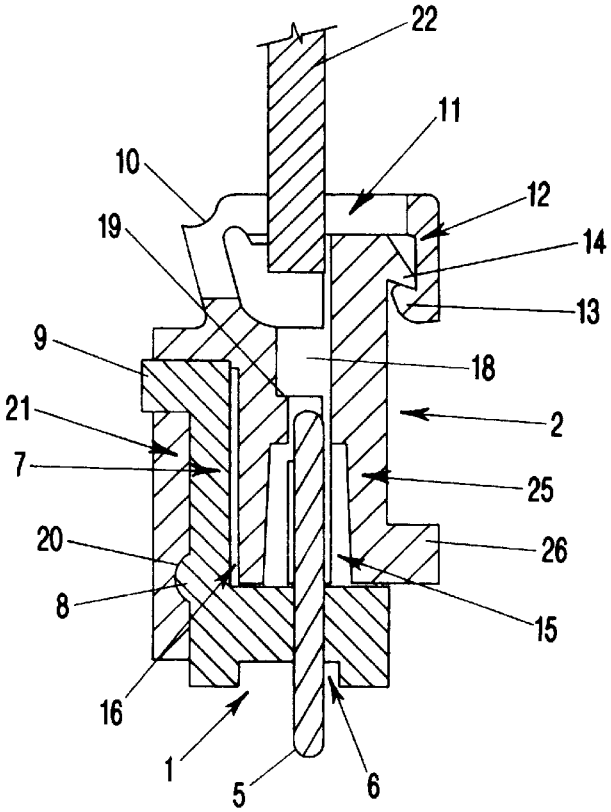
FIG. 8 shows the assembled profiled member according to FIGS. 4 and 7 in a sectional view.

As can be taken from FIGS. 5 through 8, the housing part 2 has a film joint 10 which is characterized by reduced thickness of the material within an area extending along the longitudinal side and about which a closure portion 12 provided with cutouts 11 can be pivoted. The closure section 12 is provided at its free end with a projecting catch element 13 which, in the folded state, rests at the catch element 14 of the housing part 2 having an undercut so that the closure section 12 is secured at the housing part 2, as can be seen in FIGS. 7 and 8.

The underside of the housing part 2 has two parallel openings 15, 16 extending in a channel-like fashion in the longitudinal direction which, as is shown in FIG. 8, is designed for receiving the pin holder 1. At the upper side of the channel-like opening 15 chambers 17 are provided in a grid-arrangement which house the contact elements 18 embodied as spring contacts. The contact elements 18 are designed such that in the mounted state they rest on a projection 19 surrounding the chambers 17 and are securely clamped there-at when the closure section 12 is folded and locked.

As can be seen in FIG. 8, the pin holder 1 and the housing part 2, when assembled, bring the catch projection 8 into a matching recess 20 at the inner side of the channel-like opening 16 and the pin contact elements 5 into contact at the contact elements 18. The wall 21 of the housing part 2 provided with the recess 20 is centered between the centering cams 9. While the pin-shaped contact elements 5 are soldered to a printed circuit board or a similar means, the contact elements 18 are connected to a cable 22. The individual leads of the cable 22 are connected, in a manner known to a person skilled in the art, by a crimping, IDC or soldering connection to the contact elements 18. In order to provide for a strain relief of the cable 22, the cutouts 11 through which the individual leads of the cable 22 extend are provided with constrictions 23 which effect the clamping of the individual leads of the cable 22.

The manufacture of the aforementioned plug-in connectors is carried out substantially by a three-part method. In the first part of the method, continuous profiled members are extruded by an extruder. The cross-section of the profiled members corresponds to the basic contour of the pin holder 1, respectively, the housing part 2. The profiled members are then stored in large batches or quantities for which purpose they are either wound to a coil or cut to length to form rods that are bundled.

In the second part of the method the extruded continuous profiled members (in-process stock) are removed from their storage location and transported into a first machining station which, in the case of the pin holder 1, stamps the chambers 4 and in the case of profiled members of the housing part 2 stamps the chambers 17 as well as the cutouts 11 with constrictions 23 into the plastic material. Subsequently, the chambers 4 and 17 receive the contact elements 5 and 18, respectively. In the case of the pin holder 1 the contact elements 5 are wires which, after cutting to length from a coil, are inserted into the stamped chamber 4. For shortening the manufacturing time multiple contact elements can be simultaneously introduced into the respective chambers 4. When in the first machining station profiled members for the housing part 2 are machined, the contact elements 18 are inserted into the chambers 17. The contact elements 18 are embodied as stamped spring contacts.

After positioning the contact elements 5 and 18, a quality check is carried out such that chambers 4 and 17 are checked with respect to the presence or absence of the contact elements 5 and 18 and possibly present flaws are marked. After completion of the quality control step, the profiled members provided with contact elements 5 and 18, respectively, are again wound to a coil or are stored in bundled rod form. In the case of the housing part 2 the closure section 12 is folded about the film joint 10 and is secured by the catch elements 13, 14 at the housing part 2 so that the contact elements 18 are clamped and secured in position.

For the third and last part of the method, the profiled members provided with the contact elements 5 and 18, respectively, are removed from the storage place and transported to a second machining location where they are checked for the presence of marked flaws. Subsequently, the profiled members are cut to length to form a connector blank having the desired number of contacts or poles and the connector blanks are then provided with a guide contour. The latter is performed in that a cutout (24) is provided by a stamping at the upper side of the wall 7 of the pin holder 1 so that centering cams 9 are produced. The centering cams 9 engage the wall 21 of the housing part 2 in order to provide for an aligned arrangement of the contact elements 5 and 18 relative to one another. The wall 25 of the housing 2 opposite the wall 21 is provided at its outer side with a projection 26 extending in the longitudinal direction which prevents an erroneous assembly of the pin holder 1 and the housing part 2 which could result in damage to the contact elements 5, 18.

By cutting to length the profiled members according to the required or desired number of contacts, it is possible to produce the pin holders 1 and housing parts 2 in the respective required sizes for any desired application. After sorting out the flawed components (rejects); they can be further processed for conventional printed circuit board assembly by automated processes or for processing in cable connecting machines. An especially advantageous method results when the step of furnishing the extruded profiled members with contact elements 5 and 18 at the first manufacturing station is performed either by the produces of the extruded profiled members or by a different manufacturer who buys the profiled members as blanks. The second machining station for cutting to length is then present at the facilities of a client of the manufacturer, for example, a distributer. This is so because the manufacture of the profiled members, independent of the number of required contacts, no longer requires a cost-intensive storage of individual plug-in connectors. Furthermore, since the processing of individual components is no longer needed, a reduction of the retooling time of the individual machining stations is realized which also results in time and cost savings. In addition, an increased flexibility with respect to batch size independent of the number of contacts is possible, and this also results in an increased quality because the rejection of flawed components is possible at the second machining station and takes place directly before the connectors are to be used so that this method step can also take into consideration transport damage of the connectors.

The specification incorporates by reference the disclosure of German priority document 198 01 409.0 of Jan. 16, 1998.

The present invention is, of course, in no way restricted to the specific disclosure of the specification and drawings, but also encompasses any modifications within the scope of the appended claims.

What is claimed is:

1. A method for manufacturing plug-in connectors, said method comprising the steps of:

a) extruding a continuous profiled plastic member (1) having a profile matching a desired geometry of a pin holder;

b) extruding a second continuous profiled plastic member (2) having a profile matching a desired geometry of a housing part;

c) storing the first and second continuous profiled plastic members (1, 2) in a first in-process stock;

d) providing the first and second continuous profiled plastic members (1, 2) with cutouts (4, 11, 17);

e) mounting electrical contacts (5, 18) on the first and second continuous profiled plastic members (1, 2);

f) storing the first and second continuous profiled plastic members (1, 2) in a second in-process stock;

g) cutting the first and second continuous profiled plastic members (1, 2) to length to form first and second connector blanks having a desired number of electrical contacts (5, 18);

h) forming a guide contour (9, 26) at the first and second connector blanks;

i) assembling the first and second connector blanks to form a plug-in connector.

2. The method according to claim 1, wherein in said step b) the second continuous profiled plastic member (2) is formed with a film joint (10) or the rated break line to create two parts of the second continuous profiled plastic member (2) on opposite sides of the film joint (10) or the rated break line that are foldable relative to one another and is further formed with catch elements (13, 14) at said two parts remote from the film joint (10) or the rated break line, said method further comprising the step of securing said two parts to one another by connecting said catch elements (13, 14) to one another.

3. The method according to claim 1, wherein said step d) said cutouts are chambers (4, 17) stamped into the first and second continuous profiled plastic members (1, 2) in a grid arrangement and wherein in said step e) the electrical contacts (5, 18) are mounted in said chambers (4, 17).

4. The method according to claim 1, wherein in said step d) said cutouts (11) are stamped or cut into the second continuous profiled plastic member (2) to serve as a cable guide.

5. The method according to claim 4, wherein said cutouts (11) are strain-relieved.

6. The method according to claim 1, wherein in said steps g) and h) a cutting process is employed.

7. The method according to claim 1, wherein said step a) and b) employ a multi-color extrusion process.

8. The method according to claim 1, wherein in said step i) said first and second connector blanks are secured to one another by a catch connection.

9. The method according to claim 1, wherein in said steps c) and f) the first and second continuous profiled plastic members (1, 2) are stored in the form of coils or cut-to-length rods.

10. The method according to claim 1, further comprising the step of quality control after said step e).

11. The method according to claim 1, further comprising the step of quality control after said step j).

12. The method according to claim 1, further comprising a first step of quality control after said step e) and a second step of quality control after said step j).

* * * * *